US011555606B2

(12) United States Patent
Pi et al.

(10) Patent No.: US 11,555,606 B2
(45) Date of Patent: Jan. 17, 2023

(54) LAMP

(71) Applicant: ZOPOISE TECHNOLOGY (ZHUZHOU) CO., LTD., Zhuzhou (CN)

(72) Inventors: Bruce Pi, Zhuzhou (CN); Wei Kang, Zhuzhou (CN); Bin Yao, Zhuzhou (CN)

(73) Assignee: ZOPOISE TECHNOLOGY (ZHUZHOU) CO., LTD., Zhuzhou (CN)

( * ) Notice: Subject to any disclaimer, the term of this patent is extended or adjusted under 35 U.S.C. 154(b) by 8 days.

(21) Appl. No.: 16/416,172

(22) Filed: May 18, 2019

(65) Prior Publication Data

US 2020/0173642 A1 Jun. 4, 2020

(30) Foreign Application Priority Data

Nov. 30, 2018 (CN) ..... 201811457492.1

(51) Int. Cl.
*F21V 29/85* (2015.01)
*F21V 29/503* (2015.01)
(Continued)

(52) U.S. Cl.
CPC ..... *F21V 29/86* (2015.01); *F21S 8/086* (2013.01); *F21V 29/503* (2015.01); *F21V 29/74* (2015.01);
(Continued)

(58) Field of Classification Search
CPC ..... F21V 29/86; F21V 29/503; F21V 29/74; F21V 29/83; F21V 29/89; F21S 8/086
See application file for complete search history.

(56) References Cited

U.S. PATENT DOCUMENTS 5,615,947 A * 4/1997 Shambo ..... F21V 17/20 362/268
7,513,639 B2 * 4/2009 Wang ..... F21V 29/74 362/373
(Continued)

FOREIGN PATENT DOCUMENTS

CN 203395773 I 1/2014
KR 10-2012-0005626 A 1/2012
(Continued)

OTHER PUBLICATIONS

European Search Report in application No. 19174333.5 dated Nov. 12, 2019.

*Primary Examiner* — Elmito Breval
*Assistant Examiner* — Nathaniel J Lee
(74) *Attorney, Agent, or Firm* — Maschoff Brennan

(57) ABSTRACT

Disclosed is a lamp, including a lamp body in a trough shape, a light source assembly, and a heat dissipation assembly; where, the heat dissipation assembly includes an aluminum plate, a heat dissipation fin and a glass radiator; the aluminum plate is disposed on a trough wall of the lamp body; the heat dissipation fin is disposed on a side of the aluminum plate; the glass radiator is disposed on a side of the aluminum plate; the light source assembly includes a PCB board and a plurality of LED lamp beads; the PCB board is disposed on a side of the glass radiator; and the plurality of LED lamp beads are arranged on a side of the PCB board forming a light emitting surface.

8 Claims, 3 Drawing Sheets

(51) Int. Cl.

| | |
|---|---|
| ***F21V 29/74*** | (2015.01) |
| ***F21V 29/83*** | (2015.01) |
| ***F21V 29/89*** | (2015.01) |
| ***F21S 8/08*** | (2006.01) |
| *F21Y 115/10* | (2016.01) |
| *F21W 131/103* | (2006.01) |

(52) U.S. Cl.
CPC ..... *F21V 29/83* (2015.01); *F21V 29/89* (2015.01); *F21W 2131/103* (2013.01); *F21Y 2115/10* (2016.08)

(56) References Cited

U.S. PATENT DOCUMENTS

| | | | | |
|---|---|---|---|---|
| 2004/0120152 | A1* | 6/2004 | Bolta | F21V 29/777 362/249.02 |
| 2007/0081338 | A1* | 4/2007 | Kuan | F21V 29/70 362/294 |
| 2009/0268464 | A1* | 10/2009 | Zheng | F21V 29/763 362/249.02 |
| 2012/0327641 | A1* | 12/2012 | Holder | F21V 29/70 362/249.02 |
| 2013/0148360 | A1* | 6/2013 | Jeon | F21S 8/086 362/373 |
| 2014/0218942 | A1* | 8/2014 | Song | F21V 29/83 362/382 |
| 2017/0167714 | A1* | 6/2017 | Hong | H05K 1/053 |

FOREIGN PATENT DOCUMENTS

| | | | |
|---|---|---|---|
| KR | 101344267 | B1 | 1/2014 |
| WO | 2011/059153 | A1 | 5/2011 |

* cited by examiner

LAMP

TECHNICAL FIELD

The present disclosure relates to the field of lighting technology, and in particular relates to a lamp.

BACKGROUND

LED street lamp is one kind of lighting equipment installed on roadsides. Since a large lighting area is required, it is generally suspended in high space. When a malfunction or damage is occurred, the lifting equipment is needed in general to facility the maintenance and replacement, leading to inconvenience in operation.

It is well-known that the malfunction is frequently occurred due to the poor heat dissipation performance when a LED lamp is in use. As a consequence, in order to avoid frequent maintenance and replacement of the LED street lamp, a LED street lamp structure with high heat dissipation performance is needed to be proposed.

SUMMARY

In view of this, the embodiment of the present disclosure provides a lamp for solving the technical problem that the heat dissipation performance is still poor in the LED lamp at the present stage.

The embodiment of the present disclosure provides a light, including a lamp body in a trough shape, a light source assembly, and a heat dissipation assembly;

where, the heat dissipation assembly includes an aluminum plate, a heat dissipation fin and a glass radiator; the aluminum plate is disposed on a trough wall of the lamp body; the heat dissipation fin is disposed on a side of the aluminum plate facing a trough bottom part of the lamp body; and the glass radiator is disposed on a side of the aluminum plate facing a trough top opening part of the lamp body;

the light source assembly includes a PCB board and a plurality of LED lamp beads; the PCB board is disposed on a side of the glass radiator facing away from the aluminum plate; and the plurality of LED lamp beads are arranged on a side of the PCB board facing away from the glass radiator forming a light emitting surface facing the trough top opening part.

Further, the glass radiator is a trapezoidal prism, one bottom surface having a larger area of the trapezoidal prism is attached to the aluminum plate, and the PCB board is attached to the other bottom surface and two inclined surfaces.

Further, two ends of the PCB board are respectively spaced apart from the aluminum plate by a first interval along a length direction of the trapezoidal prism.

Further, venting holes are formed on the trough wall between the aluminum plate and the trough bottom part oppositely.

Further, the heat dissipation fin is disposed on the aluminum plate along a direction of air flow in and out of the venting holes.

Further, a separator is provided in the lamp body perpendicular to the trough bottom part separating the lamp body as a first cavity and a second cavity;

the light source assembly and the heat dissipation assembly are disposed in the first cavity, and two ends of the glass radiator are respectively spaced apart from the separator and an end of the first cavity by a second interval.

The lamp further including a glass cover; where, the glass cover is coupled to an opening part of the first cavity by a hasp provided on the trough top opening part.

Further, a groove is provided along an outer edge of the glass cover, and a sealing ring is provided in the groove.

Further, a connecting plate is provided on an opening part of the second cavity, and an end of the connecting plate close to the separator is hinged to the trough top opening part;

a power source electrically connected to the PCB board is provided in the second cavity.

The lamp further including a hoop, where, the hoop is disposed on a side of the connecting plate facing the trough bottom part;

a mounting hole is formed on an end of the second cavity, and a ferrule of the hoop is opposite to the mounting hole.

The embodiment of the present disclosure discloses a lamp, including a lamp body in a trough shape, a light source assembly, and a heat dissipation assembly; where, the heat dissipation assembly includes an aluminum plate, a heat dissipation fin and a glass radiator; the aluminum plate and the heat dissipation fin form a secondary radiator to perform secondary heat dissipation on the light source assembly, thereby improving the overall heat dissipation performance of the lamp, and the malfunction rate of the lamp is reduced and the service life of the lamp is improved consequently.

BRIEF DESCRIPTION OF DRAWINGS

In order to describe the technical solutions in the embodiments of the present disclosure or the prior art more clearly, the drawings required to be used for descriptions about the embodiments or the prior art will be simply introduced below. It is apparent that the drawings described below are some embodiments of the present disclosure. Those of ordinary skill in the art may further obtain other drawings according to these drawings without creative work.

DESCRIPTION OF EMBODIMENTS

Implementations of the present disclosure will be described in detail below with reference to the accompanying drawings and embodiments, so that the implementation process of solving the technical problem by applying the technical means and achieving technical effect can be fully understood and implemented.

Certain terms used throughout the description and claims are used to refer to particular components. Those skilled in the art will understand that hardware manufacturers may call the same component by different nouns. The present description and claims do not use a name difference as a mode for distinguishing the components, but the functional difference of the components is taken as a criterion for distinguishing. The word "comprising" as used throughout the description and claims is an open term and should be interpreted as "comprising but not limited to". "Substantially" means that within an acceptable error range, those skilled in the art will be able to solve the technical problems within a certain error range, basically achieving the technical effects. In addition, the term "coupled" is used herein to include any direct and indirect electrical coupling means. Therefore, if it is described here that a first apparatus is coupled to a second apparatus, it is indicated that the first apparatus may be directly and electrically coupled to the second apparatus or indirectly and electrically coupled to the second apparatus through other apparatuses or coupling means. The description is described as an implementation mode for implementing the present disclosure. However, the description is intended to be illustrative of the general principle of the present disclosure, and is not intended to limit the scope of the present disclosure. The scope of protection of the present disclosure is subject to the definition of the appended claims.

It is also to be noted that terms "include", "contain" or any other variants thereof are intended to include nonexclusive inclusions, thereby ensuring that a commodity or system including a series of elements not only includes those elements but also includes other elements which are not clearly listed or further includes elements intrinsic to the commodity or the system. Under the condition of no more restrictions, an element defined by statement "including a/an" does not exclude existence of another element which is the same in a commodity or system including the element.

Specific Embodiments

Figure 1:
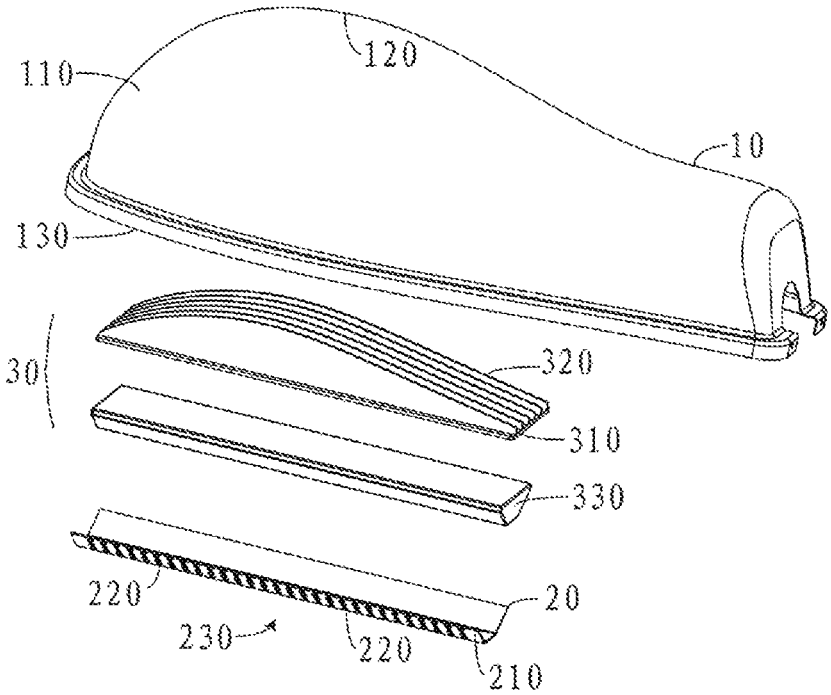
FIG. 1 is a schematic exploded view of a three-dimensional structure of a lamp according to an embodiment of the present disclosure.
Figure 2:
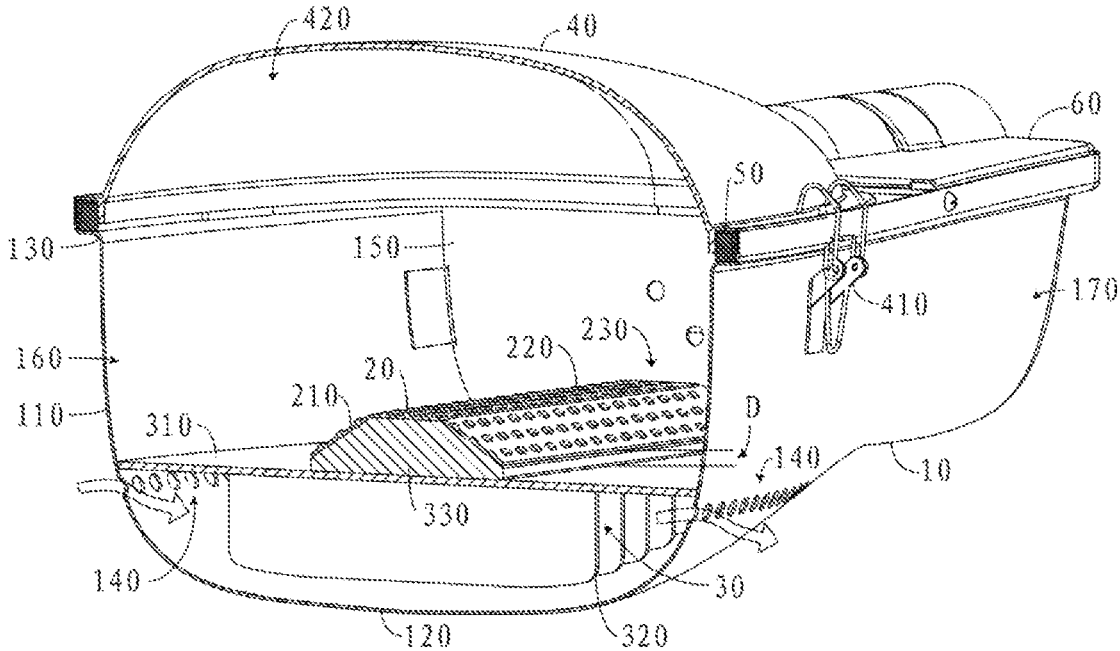
FIG. 2 is a cross-sectional view of a lamp according to an embodiment of the present disclosure.
Figure 3:
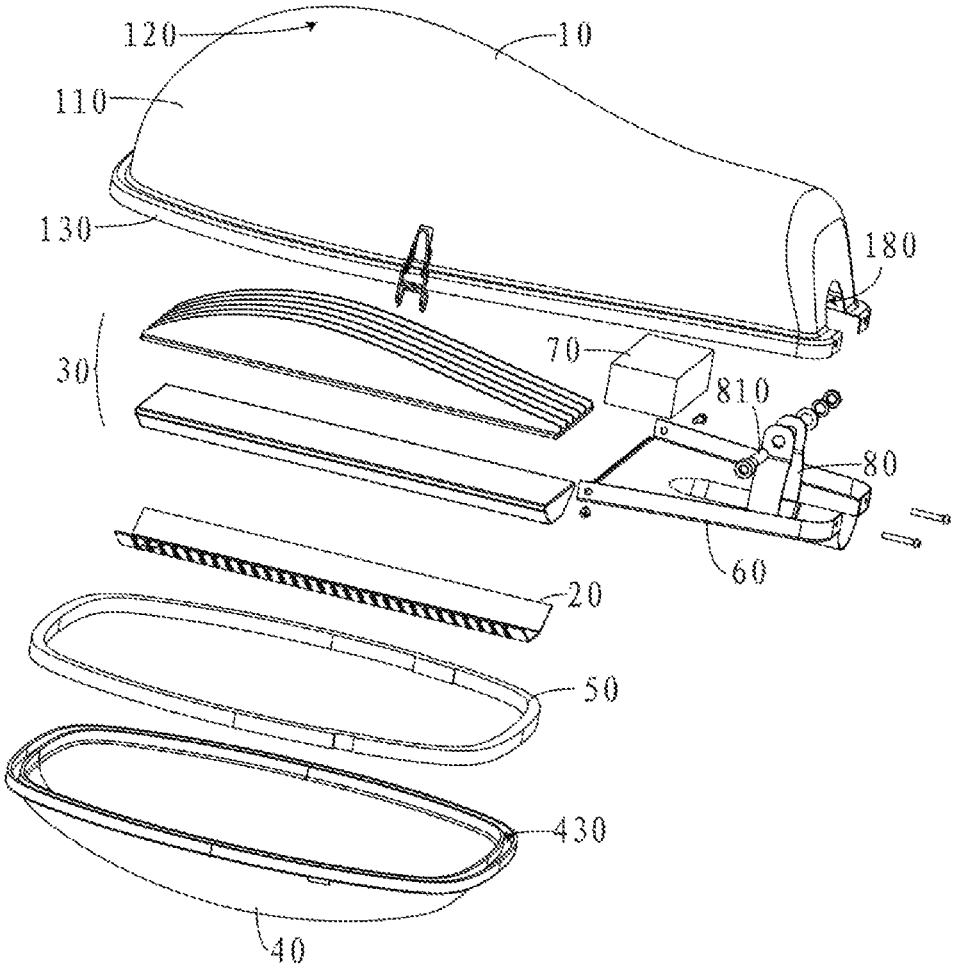
FIG. 3 is a schematic exploded view of another three-dimensional structure of a lamp according to an embodiment of the present disclosure.
Figure 4:
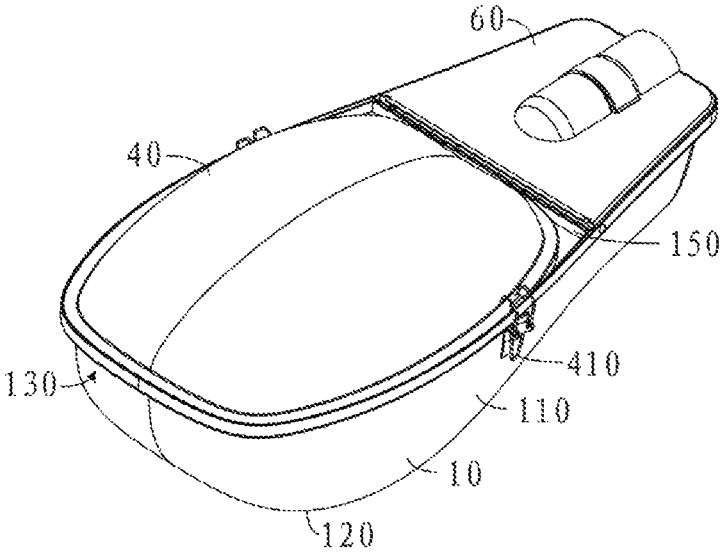
FIG. 4 is a schematic view of a three-dimensional structure of a lamp according to an embodiment of the present disclosure.
Figure 5:
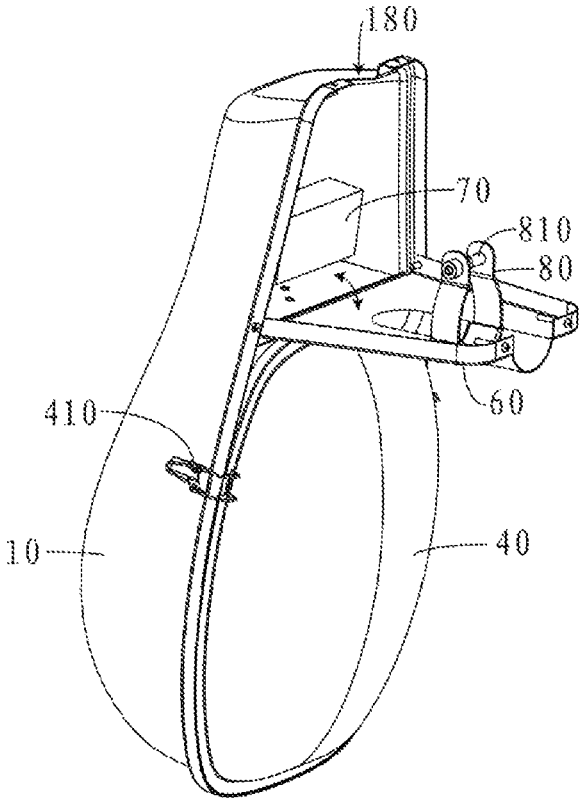
FIG. 5 is a schematic view of an open state of a connecting plate of a lamp according to an embodiment of the present disclosure.

Please refer to FIG. 1, which is a schematic exploded view of a three-dimensional structure of a lamp according to an embodiment of the present disclosure. The lamp includes a lamp body in a trough shape 10, a light source assembly 20, and a heat dissipation assembly 30.

The heat dissipation assembly 30 includes an aluminum plate 310, a heat dissipation fin 320, and a glass radiator 330. The aluminum plate 310 is disposed on a trough wall 110 of the lamp body 10. The heat dissipation fin 320 is disposed on a side of the aluminum plate 310 facing a trough bottom part 120 of the lamp body 10. The glass radiator 330 is disposed on a side of the aluminum plate 310 facing a trough top opening part 130 of the lamp body 10.

Specifically, an outer edge of the aluminum plate 310 is coupled to the trough wall 110. In the preferred embodiment, the aluminum plate 310 is parallel to the trough bottom part 120, and the aluminum plate 310 separates the lamp body 10 into an upper space and a lower space. The heat dissipation fin 320 and the glass radiator 330 are separated from two sides of the aluminum plate 310, the heat dissipation fin 320 is located in the upper space close to the trough bottom part 120 of the groove, and the glass radiator 330 is located in the lower space close to the trough top opening part 130.

The light source assembly 20 includes a PCB board 210 and a plurality of LED lamp beads 220. The PCB board 210 is disposed on a side of the glass radiator 330 facing away from the aluminum plate 310, and the plurality of LED lamp beads 220 are arranged on a side of the PCB board 210 facing away from the glass radiator 330 forming a light emitting surface 230 facing the trough top opening part 130.

Specifically, the plurality of LED lamp bead 220 are arranged on the PCB board 210 in an array forming the light emitting surface 230, and the side of the PCB board 210 not provided with the LED lamp beads is attached to the glass radiator 330 facing away from the aluminum plate 310, such that the light emitting surface 230 faces the trough top opening part 130 of the lamp body 10, and the light emitted from the light emitting surface 230 is directed toward the outside of the lamp body 10 through the trough top opening part 130.

When the lamp of the embodiment of the present disclosure is in use that the plurality of LED lamp beads 220 are illuminated, heat is generated and transmitted sequentially to the PCB board 210 and the glass radiator 330 where the heat can be radiated into the air faster, that is the high heat radiation performance of the glass radiator 330 provides a better heat dissipation effect. In addition, the aluminum plate 310 and the heat dissipation fin 320 constitute a radiator which also facilities the glass radiator 330 to radiate heat that radiates the heat on the glass radiator 330 into the space above the aluminum plate 310 to perform heat exchange with the air therein, to achieve secondary heat dissipation on the light source assembly 20 of the lamp, thereby improving the overall heat dissipation performance of the lamp, and the malfunction rate of the lamp is reduced and the service life of the lamp is improved consequently.

Please refer to FIG. 2 to FIG. 5, in another preferred embodiment of the present disclosure, the glass radiator 330 is a trapezoidal prism, one bottom surface having a larger area of the trapezoidal prism is attached to the aluminum plate 310, and the PCB board 210 is attached to the other bottom surface and two inclined surfaces.

Specifically, the glass radiator 330 is a prismatic structure having a trapezoidal cross section, that is the trapezoidal prism, and the trapezoidal prism has an upper bottom surface, a lower bottom surface, and two inclined surfaces between the upper bottom surface and the lower bottom surface. One bottom surface having a larger area is attached to the aluminum plate 310, and the PCB board 210 is attached to the other surfaces except the bottom surface, that is, attached to the upper bottom surface and the two inclined surfaces. This structural can increase the area of the light emitting surface 230 to improve the lighting effect of the lamp.

Further, two ends of the PCB board 210 are respectively spaced apart from the aluminum board 310 by a first interval D along a length direction of the trapezoidal prism.

Specifically, the PCB board 210 is not completely wrapped on the upper bottom surface and the two inclined surfaces of the trapezoidal prism. The area in a bottom part about a first interval D of the two inclined surfaces of the trapezoidal prism is not provided with the PCB board 210, that is, the glass radiator 330 in the first interval D is exposed in the space of the aluminum plate 310 facing the trough top opening part 130. This structure benefits the heat radiation between the glass radiator 330 and the external air, which can effectively improve the heat dissipation performance of the glass radiator 330 regarding the light source assembly 20.

In addition, in other preferred embodiments of the present disclosure, venting holes 140 are formed on the trough wall 110 between the aluminum plate 310 and the trough bottom part 120 oppositely.

Specifically, a plurality of the venting holes 140 are formed on the trough wall 110 in the upper space of the aluminum plate 310 facing the trough bottom part 120, and the venting holes 140 of the opposite side through wall are oppositely formed. This structure may enable the cold air around the lamp to enter the lamp body 10 through the venting holes 140, as shown by the direction of the arrow in FIG. 2, forming air convection, such that the radiator constituted by the aluminum plate 310 and the heat dissipation fin 320 is in sufficient contact with the cold air to improve the heat dissipation capability of the glass radiator 330, thereby improving the heat dissipation performance of the light source assembly 20.

Further, the heat dissipation fin 320 is disposed on the aluminum plate 310 along a direction of air flow in and out of the venting holes 140.

Specifically, the heat dissipation fin 320 is disposed along the direction of air flow in and out of the lamp body 10. Two adjacent heat dissipation fins 320 form a heat dissipation channel, and two ends of which connect two venting holes 140 formed oppositely. This structure can improve the contact area between the radiator constituted by the aluminum plate 310 and the heat dissipation fin 320 and the cold air, such that the two can be more fully contacted, and further improve the heat dissipation capability of 330, thereby improving the heat dissipation performance of the light source assembly 20.

Further, in another preferred embodiment of the present disclosure, a separator 150 is provided in the lamp body 10 perpendicularly to the trough bottom part 120 separating the lamp body 10 as a first cavity 160 and a second cavity 170.

Where, the light source assembly 20 and the heat dissipation assembly 30 are disposed in the first cavity 160, and two ends of the glass radiator 330 are respectively spaced apart from the separator 150 and an end of the first cavity 160 by a second interval (not shown).

Specifically, the separator 150 is perpendicularly disposed on the trough bottom part 120 vertically to a longitudinal direction of the lamp body 10 to separate the lamp body 10 as the first cavity 160 and the second cavity 170. The light source assembly 20 and the heat dissipation assembly 30 are disposed in the first cavity 160, and the two ends of the glass radiator 330 are not in fully contact with the separator 150 and end of the lamp body 10 in the first cavity 160, but are separated by the second interval. This structural can improve the contact area between the glass radiator 330 and the external air and improve the heat exchange capability of the glass radiator 330, that is, effectively improve the heat dissipation capability of the glass radiator 330, thereby further improving the heat dissipation performance of the light source assembly 20 of the lamp.

In addition, in other preferred embodiments of the present disclosure, the lamp further includes a glass cover 40. The glass cover 40 is coupled to an opening part of the first cavity 160 by a hasp 410 provided on the trough top opening part 130.

Specifically, in order to improve the safety of use of the lamp, the glass cover 40 is disposed on an opening part of the first cavity 160 to form a closed space 420, and the light source assembly 20 and the heat dissipation assembly 30 are located in the enclosed space 420. The glass cover 40 has good light transmittance, and can ensure that the light generated by the light emitting surface 230 can be smoothly emitted. The coupling between the glass cover 40 and the lamp body 10 is realized by the hasp 410 provided on the trough top opening part 130. The hasp 410 can realize a one button operation to open the glass cover 40, which facilitates the installation and disassembly of the lamp, and improve the operability of the lamp.

Further, in order to improve the compatibility of the enclosed space 420 and further improve the safety of use of the lamp, a sealing ring 50 is provided between the glass cover 40 and the opening part of the first cavity 160. Specifically, a groove 430 is provided along an outer edge of the cover glass 40, and the seal ring 50 is disposed in the groove 430.

In addition, a connecting plate 60 is provided on an opening part of the second cavity 170, and an end of the connecting plate 60 close to the separator 150 is hinged to the trough top opening part. A power source 70 electrically connected to the PCB board 210 is provided in the second cavity 170.

Specifically, the power source 70 is disposed on the trough bottom part 120 of the second cavity 170, and the power source 70 is electrically connected to the PCB board 210 in the first cavity 160 through a wire. The separator 150 is provided with a through hole through which the wire passes. The connecting plate 60 covers the opening part of the second cavity 170, one end close to the separator 150 is hinged to the trough top opening part 130, and the other end is coupled the trough top opening part 130 through a coupling member. A coupling way of the coupling member therein includes but is not limited to a screw connection, a snap connection, etc. This structure can facility the opening of the second cavity 170 by opening the coupling member while the connecting plate 60 rotates around another hinge end as shown by the direction of the arrow in FIG. 5, when the structure of the second cavity 170 needs to be repaired or replaced, thereby further improving the operability of the lamp.

Further, the lamp further includes a hoop 80. The hoop 80 is disposed on a side of the connecting plate 60 facing the trough bottom part 120. A mounting hole 180 is formed on an end of the second cavity 170, and a ferrule of the hoop 80 is opposite to the mounting hole 180.

Specifically, the hoop 80 is used to connect an external mounting structure. The external mounting structure therein includes but is not limited to a mounting post that passes through the mounting hole 180 disposed on an end in the second cavity and extends into the ferrule of the hoop 80, and the hoop 80 is fixed on the mounting post by the fixing of a connecting screw rod 810 on the hoop 80, to fix the lamp on the mounting post.

It should be noted that, in the case that the structures do not conflict, the structures of each part mentioned in the above embodiments may be combined with each other. To avoid repetition, the technical solutions obtained after the combination are not described herein again, but are the technical solutions obtained after combination should also fall within the scope of protection of the present disclosure.

It is finally to be noted that the above embodiments are adopted not to limit but only to describe the technical solutions of the present disclosure. Although the present disclosure has been described with reference to the above-mentioned embodiments in detail, those of ordinary skill in the art should know that modifications may still be made to the technical solutions recorded in each embodiment or equivalent replacements may be made to part of technical features therein. These modifications or replacements do not make the essences of the corresponding technical solutions depart from the spirit and scope of the technical solutions of each embodiment of the present disclosure.

The invention claimed is:

1. A lamp, comprising:

a lamp body in a trough shape, a light source assembly, and a heat dissipation assembly;

wherein:

the heat dissipation assembly comprises an aluminum plate, heat dissipation fins and a glass radiator;

the aluminum plate is disposed on a side wall of the lamp body, and the aluminum plate has a first surface facing a trough bottom part of the lamp body and a second surface facing a trough top opening part of the lamp body; the heat dissipation fins are disposed on the first surface of the aluminum plate;

the glass radiator is disposed on the second surface of the aluminum plate;

the light source assembly comprises a PCB board and a plurality of LED lamp beads;

the PCB board is disposed on a side of the glass radiator facing away from the aluminum plate; and the plurality of LED lamp beads are arranged on a side of the PCB board facing away from the glass radiator forming a light emitting surface facing the trough top opening part;

pairs of venting holes are formed on the side wall between the aluminum plate and the trough bottom part, the pairs of venting holes are disposed along a direction parallel to the aluminum plate, and two venting holes in one pair of the venting holes face each other;

wherein each of the heat dissipation fins is disposed along a direction of a connecting line of two venting holes in one pair of the venting holes, an area between two adjacent heat dissipation fins forms a heat dissipation channel, two ends of the heat dissipation channel only connect two venting holes in one pair.

2. The lamp according to claim 1, wherein, the glass radiator is a trapezoidal prism, one bottom surface having a larger area of the trapezoidal prism is attached to the aluminum plate, and the PCB board is attached to the other bottom surface and two inclined surfaces.

3. The lamp according to claim 2, wherein, two ends of the PCB board are respectively spaced apart from the aluminum plate by a first interval along a length direction of the trapezoidal prism.

4. The lamp according to claim 1, wherein a separator is provided in the lamp body perpendicularly to the trough bottom part separating the lamp body as a first cavity and a second cavity; and the light source assembly and the heat dissipation assembly are disposed in the first cavity, and two ends of the glass radiator are respectively spaced apart from the separator and an end of the first cavity by a second interval.

5. The lamp according to claim 4, further comprising a glass cover; wherein, the glass cover is coupled to an opening part of the first cavity by a hasp provided on the trough top opening part.

6. The lamp according to claim 5, wherein, a groove is provided along an outer edge of the glass cover, and a sealing ring is provided in the groove.

7. The lamp according to claim 4, wherein:

a connecting plate is provided on an opening part of the second cavity, and an end of the connecting plate close to the separator is hinged to the trough top opening part; and a power source electrically connected to the PCB board is provided in the second cavity.

8. The lamp according to claim 7, further comprising a hoop, wherein:

the hoop is disposed on a side of the connecting plate facing the trough bottom part; and a mounting hole is formed on an end of the second cavity, and a ferrule of the hoop is opposite to the mounting hole.

* * * * *